US006464504B1

(12) United States Patent
Wingert

(10) Patent No.: US 6,464,504 B1
(45) Date of Patent: Oct. 15, 2002

(54) MATHEMATICAL GAME OF AMUSEMENT

(76) Inventor: Diane Wingert, 11000 S. Eastern, Henderson, NV (US) 89052

( * ) Notice: Subject to any disclaimer, the term of this patent is extended or adjusted under 35 U.S.C. 154(b) by 0 days.

(21) Appl. No.: 09/961,741

(22) Filed: Sep. 24, 2001

(51) Int. Cl.[7] ..... A63B 65/00; F41J 3/00

(52) U.S. Cl. ..... 434/188; 273/399; 273/405; 273/355; 124/16; 473/569

(58) Field of Search ..... 434/188, 128–129; 273/317.1, 317.7; 124/16–29, 31, 33; 116/222; 473/569

(56) References Cited

U.S. PATENT DOCUMENTS 614,094 A * 11/1898 Farnum ..... 124/4
817,928 A * 4/1906 Medley ..... 124/7
1,576,515 A * 3/1926 Kinney ..... 124/4
3,356,369 A * 12/1967 Stubbmann ..... 124/16
3,358,998 A * 12/1967 Goldfarb ..... 124/26
3,528,385 A * 9/1970 Kohner ..... 116/222
3,545,101 A * 12/1970 Fike ..... 273/269
3,635,204 A * 1/1972 Plumb, Jr. ..... 124/16
3,709,495 A * 1/1973 Krombein ..... 124/26
3,715,121 A * 2/1973 Renn ..... 124/41.1
3,787,053 A * 1/1974 Breslow ..... 124/16
4,118,026 A * 10/1978 Todokoro ..... 273/412
4,129,110 A * 12/1978 Kubrak ..... 124/16
5,435,570 A * 7/1995 Labrasseur ..... 273/355
5,454,566 A * 10/1995 Koenig ..... 273/108
5,997,305 A * 12/1999 Mangles ..... 434/188
6,079,710 A * 6/2000 Brown ..... 273/269

* cited by examiner

*Primary Examiner*—Derris H. Banks
*Assistant Examiner*—Dmitry Suhol
(74) *Attorney, Agent, or Firm*—Goldstein & Lavas, P.C.

(57) ABSTRACT

A mathematical game of amusement including a game board having generally planar upper and lower surfaces. The game board has a square center aperture therethrough. The upper surface of the game board is divided into a series of spaces. Each of the spaces has a predetermined point value associated therewith. A selected number of the spaces are designated as bonus spaces. A launching mechanism is positionable within the square center aperture of the game board. A plurality of disc-shaped game pieces are dimensioned for being positioned atop the launching mechanism. The game pieces are divided into at least two sets of game pieces distinguishable from one another by color. The game pieces are launchable by the launching mechanism onto the series of spaces of the game board to achieve a score.

5 Claims, 3 Drawing Sheets

MATHEMATICAL GAME OF AMUSEMENT

BACKGROUND OF THE INVENTION

The present invention relates to a mathematical game of amusement and more particularly pertains to teaching basic mathematics while providing a source of amusement.

The use of games for amusement purposes is known in the prior art. More specifically, games for amusement purposes heretofore devised and utilized for the purpose of providing amusement are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,337,949 to Ferris discloses a game in which a disc shaped playing pieces are propelled to land on a surface that is divided into a plurality of compartments. U.S. Pat. No. 5,435,570 to Labrasseur discloses a game comprised of means for launching projectiles toward a target. U.S. Pat. No. 3,206,209 to Farrah discloses a game comprised of projecting a disc toward a goal.

While these devices fulfill their respective, particular objective and requirements, the aforementioned patents do not describe a mathematical game of amusement for teaching basic mathematics while providing a source of amusement.

In this respect, the mathematical game of amusement according to the present invention substantially departs from the conventional concepts and designs of the prior art, and in doing so provides an apparatus primarily developed for the purpose of teaching basic mathematics while providing a source of amusement.

Therefore, it can be appreciated that there exists a continuing need for a new and improved mathematical game of amusement which can be used for teaching basic mathematics while providing a source of amusement. In this regard, the present invention substantially fulfills this need.

SUMMARY OF THE INVENTION

In the view of the foregoing disadvantages inherent in the known types of games for amusement purposes now present in the prior art, the present invention provides an improved mathematical game of amusement. As such, the general purpose of the present invention, which will be described subsequently in greater detail, is to provide a new and improved mathematical game of amusement which has all the advantages of the prior art and none of the disadvantages.

To attain this, the present invention essentially comprises a game board having a generally square configuration. The game board has a flexible construction. The game board has generally planar upper and lower surfaces. The game board has a square center aperture therethrough. The upper surface of the game board is divided into a series of spaces. Each of the spaces has a predetermined point value associated therewith. A selected number of the spaces are designated as bonus spaces. A launching mechanism is positionable within the square center aperture of the game board. The launching mechanism consists of a housing having a generally square configuration. The housing has an upper end, a lower end, opposed side walls, and a hollow interior. The upper end has a central aperture therethrough. Each of the opposed side walls has an opening therethrough. The launching mechanism includes a spring extending upwardly from the lower end of the housing. The spring has an upper end positioned immediately below the central aperture in an extended orientation. The launching mechanism includes a launching disc secured to the upper end of the spring. The launching disc has a lesser diameter than a diameter of the central aperture. The launching disc has a peripheral lip extending downwardly therefrom. The peripheral lip has a plurality of radial tabs extending outwardly therefrom. The radial tabs each have outer portions extending outwardly of the openings in the side walls. A plurality of disc-shaped game pieces are dimensioned for being positioned atop the launching disc of the launching mechanism. The game pieces are divided into at least two sets of game pieces distinguishable from one another by color. The game pieces are launchable by the launching mechanism onto the series of spaces of the game board to achieve a score.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved mathematical game of amusement which has all the advantages of the prior art games for amusement purposes and none of the disadvantages.

It is another object of the present invention to provide a new and improved mathematical game of amusement which may be easily and efficiently manufactured and marketed.

It is a further object of the present invention to provide a new and improved mathematical game of amusement which is of durable and reliable construction.

An even further object of the present invention is to provide a new and improved mathematical game of amusement which is susceptible of a low cost of manufacture with regard to both materials and labor, and which accordingly is then susceptible of low prices of sale to the consuming public, thereby making such a mathematical game of amusement economically available to the buying public.

Even still another object of the present invention is to provide a new and improved mathematical game of amusement for teaching basic mathematics while providing a source of amusement.

Lastly, it is an object of the present invention to provide a new and improved mathematical game of amusement including a game board having generally planar upper and lower surfaces. The game board has a square center aperture therethrough. The upper surface of the game board is divided into a series of spaces. Each of the spaces has a predetermined point value associated therewith. A selected number of the spaces are designated as bonus spaces. A launching mechanism is positionable within the square center aperture of the game board. A plurality of disc-shaped game pieces are dimensioned for being positioned atop the launching mechanism. The game pieces are divided into at least two sets of game pieces distinguishable from one another by color. The game pieces are launchable by the launching mechanism onto the series of spaces of the game board to achieve a score.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
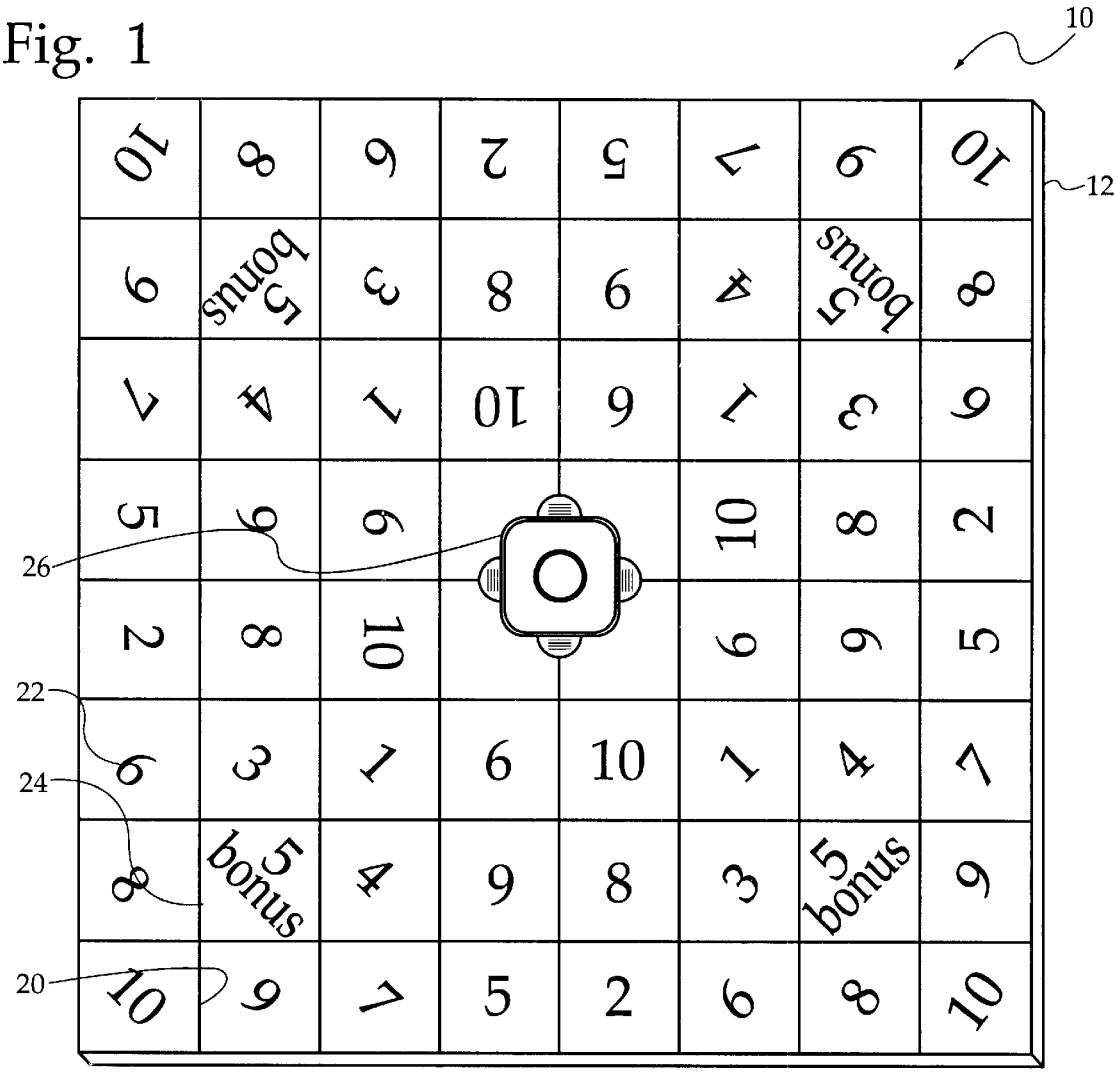
FIG. 1 is a perspective view of the preferred embodiment of the mathematical game of amusement constructed in accordance with the principles of the present invention.
Figure 2:
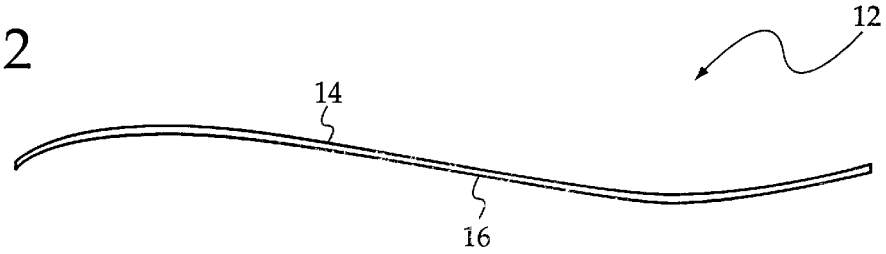
FIG. 2 is a side view of the game board of the present invention.
Figure 3:
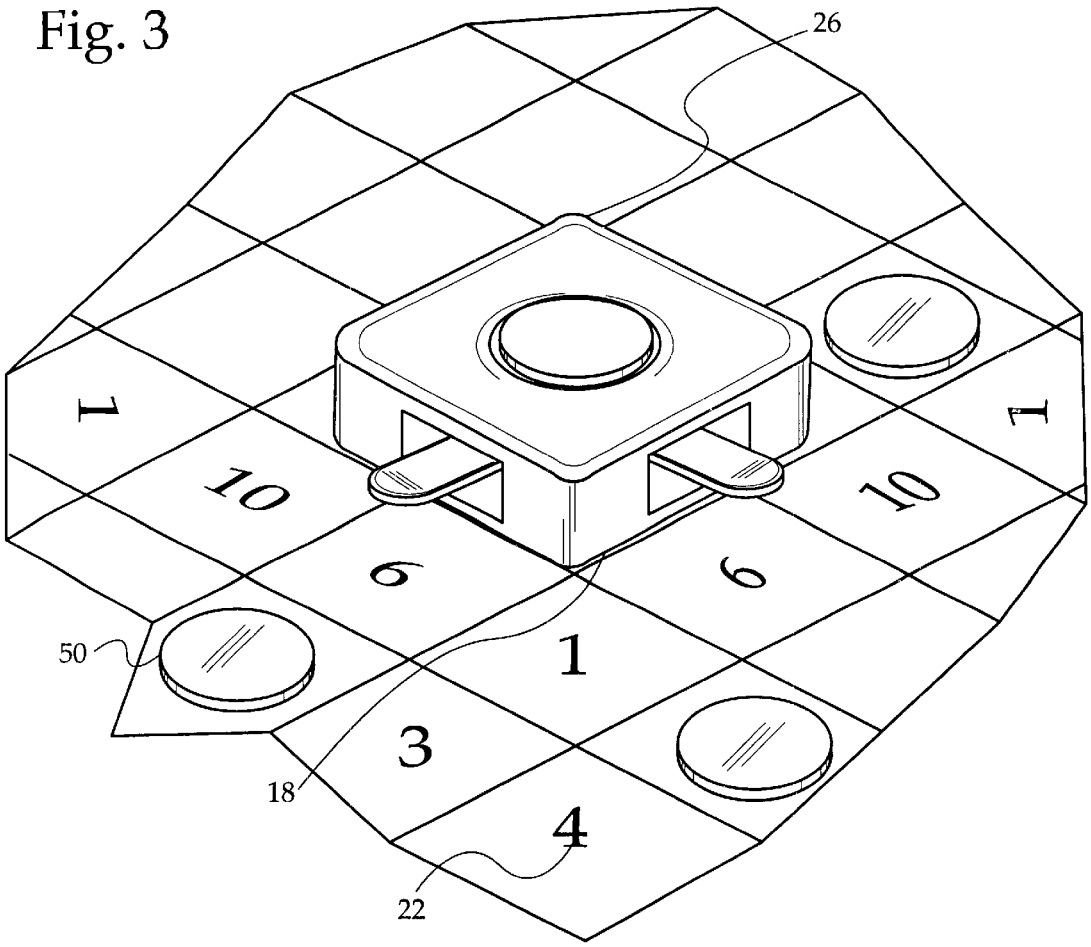
FIG. 3 is a sectional perspective view of the present invention.
Figure 4:
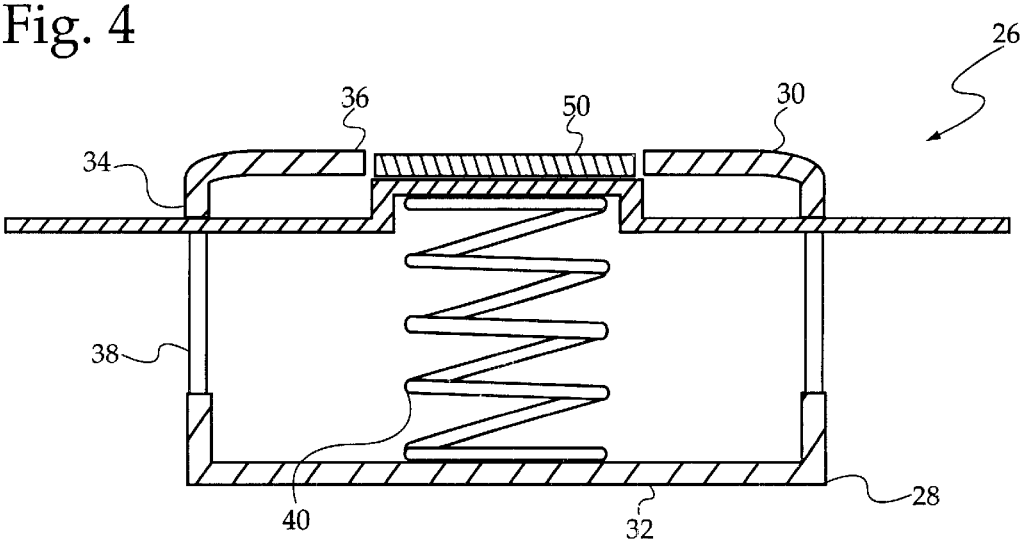
FIG. 4 is a cross-sectional side view of the launching mechanism of the present invention.
Figure 5:
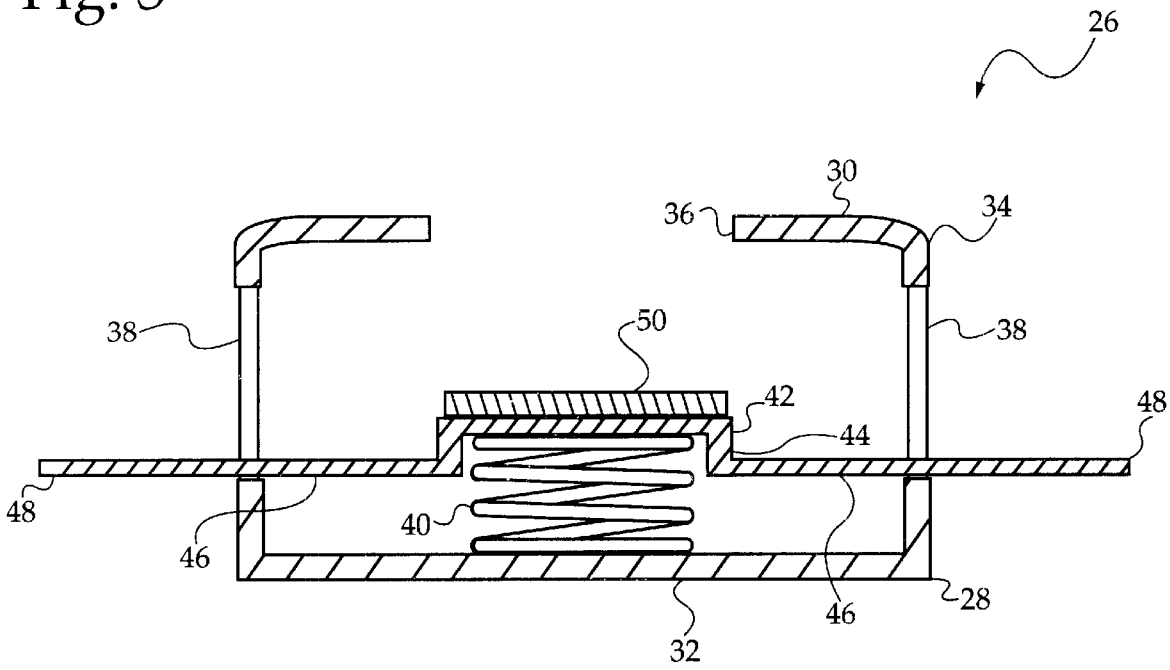
FIG. 5 is a cross-sectional side view of the launching mechanism of the present invention illustrated in use.

With reference now to the drawings, and in particular, to FIGS. 1 through 5 thereof, the preferred embodiment of the new and improved mathematical game of amusement embodying the principles and concepts of the present invention and generally designated by the reference number 10 will be described.

Specifically, it will be noted in the various Figures that the device relates to a mathematical game of amusement for teaching basic mathematics while providing a source of amusement. In its broadest context, the device consists of a game board, a launching mechanism, and a plurality of disc-shaped game pieces. Such components are individually configured and correlated with respect to each other so as to attain the desired objective.

The game board 12 has a generally square configuration. Note FIG. 1. The game board 12 has a flexible construction. Note FIG. 2. Preferably, the game board will be constructed of a flexible, yet durable vinyl. The game board 12 has generally planar upper 14 and lower surfaces 16. The game board 12 has a square center aperture 18 therethrough. The upper surface 14 of the game board 12 is divided into a series of spaces 20. Each of the spaces 20 have a predetermined point value 22 associated therewith. The point value 22 can be varied to change the difficulty of the game. Point values that are higher will obviously require greater mathematical skill. A selected number of the spaces 20 are designated as bonus spaces 24. The bonus spaces 24 will be discussed in greater detail hereinafter.

The launching mechanism 26 is positionable within the square center aperture 18 of the game board 12. Note FIGS. 1 and 3. The launching mechanism 26 consists of a housing 28 having a generally square configuration. The housing 28 has an upper end 30, a lower end 32, opposed side walls 34, and a hollow interior. The upper end 30 has a central aperture 36 therethrough. The lower end 32 can be provided with a rubber coating thereon to prevent the launching mechanism 26 from sliding during use. Each of the opposed side walls 34 has an opening 38 therethrough. The launching mechanism 26 includes a spring 40 extending upwardly from the lower end 32 of the housing 28. The spring 40 has an upper end positioned immediately below the central aperture 36 in an extended orientation. The launching mechanism 26 includes a launching disc 42 secured to the upper end of the spring 40. The launching disc 42 has a lesser diameter than a diameter of the central aperture 42. This feature will allow the launching disc 42 to slide freely through the central aperture 36 during operation. The launching disc 42 has a peripheral lip 44 extending downwardly therefrom. The peripheral lip 44 has a plurality of radial tabs 46 extending outwardly therefrom. The radial tabs 46 each have outer portions 48 extending outwardly of the openings 38 in the side walls 34.

The plurality of disc-shaped game pieces 50 are dimensioned for being positioned atop the launching disc 42 of the launching mechanism 26. The game pieces 50 are divided into at least two sets of game pieces distinguishable from one another by color. The game pieces 50 are launchable by the launching mechanism 42 onto the series of spaces 20 of the game board 12 to achieve a score. The game pieces 50 have a diameter corresponding with the launching pad 42 to allow for the passage through the central aperture 36.

The play of the game is simple. One by one, a player places a game piece 50 atop the launching disc 42 and presses downwardly on two of the radial tabs 46 causing the launching disc 42 to move downwardly against the spring 40. The player then releases the two radial tabs 46 allowing the spring 40 to recoil thereby propelling the game piece 50 onto one of the spaces 20 of the game board 12. However, at least 75% of the game piece 50 must be within the space 20 for a player to receive the point value 22 associated with the space 20. If the game piece 50 is not at least 75% within a single space 20, no point value will be collected. If the player lands on the space 20 designated a bonus space 24, that player will be rewarded fifty points and receive an additional game piece 50 for use on another turn. The players simply add up all of their points with the player having the most points declared the winner.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A mathematical game of amusement for teaching basic mathematics while providing a source of amusement comprising, in combination:

a game board having a generally square configuration, the game board having a flexible construction, the game board having generally planar upper and lower surfaces, the game board having a square center aperture therethrough, the upper surface of the game board being divided into a series of spaces, each of the spaces having a predetermined point value associated therewith, a selected number of the spaces being designated as bonus spaces;

a launching mechanism positionable within the square center aperture of the game board, the launching mechanism being comprised of a housing having a generally square configuration, the housing having an upper end, a lower end, opposed side walls, and a hollow interior, the upper end having a central aperture therethrough, each of the opposed side walls having an opening therethrough, the launching mechanism including a spring extending upwardly from the lower end of the housing, the spring having an upper end positioned immediately below the central aperture in an extended orientation, the launching mechanism including a launching disc secured to the upper end of the spring, the launching disc having a lesser diameter than a diameter of the central aperture, the launching disc having a peripheral lip extending downwardly therefrom, the peripheral lip having a plurality of radial tabs extending outwardly therefrom, the radial tabs each having outer portions extending outwardly of the openings in the side walls; and a plurality of circular disc-shaped game pieces dimensioned for being positioned atop the launching disc of the launching mechanism, the game pieces being divided into at least two sets of game pieces distinguishable from one another by color, the game pieces being launchable by the launching mechanism onto the series of spaces of the game board to achieve a score.

2. A mathematical game of amusement for teaching basic mathematics while providing a source of amusement comprising, in combination:

a game board having generally planar upper and lower surfaces, the game board having a square center aperture therethrough, the upper surface of the game board being divided into a series of spaces, each of the spaces having a predetermined point value associated therewith, a selected number of the spaces being designated as bonus spaces;

a launching mechanism positionable within the square center aperture of the game board; and a plurality of circular disc-shaped game pieces dimensioned for being positioned atop the launching mechanism, the game pieces being divided into at least two sets of game pieces distinguishable from one another by color, the game pieces being launchable by the launching mechanism onto the series of spaces of the game board to achieve a score.

3. The mathematical game of amusement as set forth in claim 2, wherein the launching mechanism consists of a housing having a generally square configuration, the housing having an upper end, a lower end, opposed side walls, and a hollow interior, the upper end having a central aperture therethrough, each of the opposed side walls having an opening therethrough, the launching mechanism including a spring extending upwardly from the lower end of the housing, the spring having an upper end positioned immediately below the central aperture in an extended orientation, the launching mechanism including a launching disc secured to the upper end of the spring.

4. The mathematical game of amusement as set forth in claim 2, wherein the launching disc has a peripheral lip extending downwardly therefrom, the peripheral lip having a plurality of radial tabs extending outwardly therefrom, the radial tabs each having outer portions extending outwardly of the openings in the side walls.

5. A mathematical game of amusement and method of play comprising, in combination:

providing a game board having a generally square configuration, the game board having a flexible construction, the game board having generally planar upper and lower surfaces, the game board having a square center aperture therethrough, the upper surface of the game board being divided into a series of spaces, each of the spaces having a predetermined point value associated therewith, a selected number of the spaces being designated as bonus spaces;

providing a launching mechanism positionable within the square center aperture of the game board, the launching mechanism being comprised of a housing having a generally square configuration, the housing having an upper end, a lower end, opposed side walls, and a hollow interior, the upper end having a central aperture therethrough, each of the opposed side walls having an opening therethrough, the launching mechanism including a spring extending upwardly from the lower end of the housing, the spring having an upper end positioned immediately below the central aperture in an extended orientation, the launching mechanism including a launching disc secured to the upper end of the spring, the launching disc having a lesser diameter than a diameter of the central aperture, the launching disc having a peripheral lip extending downwardly therefrom, the peripheral lip having a plurality of radial tabs extending outwardly therefrom, the radial tabs each having outer portions extending outwardly of the openings in the side walls;

providing a plurality of circular disc-shaped game pieces dimensioned for being positioned atop the launching disc of the launching mechanism, the game pieces being divided into at least two sets of game pieces distinguishable from one another by color, the game pieces being launchable by the launching mechanism onto the series of spaces of the game board to achieve a score; and wherein one by one, a player places a game piece atop the launching disc and presses downwardly on two of the radial tabs causing the launching disc to move downwardly against the spring, the player then releases the two radial tabs allowing the spring to recoil thereby propelling the game piece onto one of the spaces of the game board, whereby at least 75% of the game piece is within the space for a player to receive the point value associated with the space.

* * * * *